United States Patent [19]

Miles

[11] Patent Number: 4,915,335

[45] Date of Patent: Apr. 10, 1990

[54] LAWN CHAIR STABILIZER

[76] Inventor: Virgil P. Miles, P.O. Box 342, Etna, Calif. 96027

[21] Appl. No.: 328,613

[22] Filed: Mar. 27, 1989

[51] Int. Cl.[4] ..... F16M 11/20

[52] U.S. Cl. ..... 248/188.8

[58] Field of Search ..... 248/188.8, 188.2, 188.4, 248/188.9, 188.91, 500, 501; 297/463

[56] References Cited

U.S. PATENT DOCUMENTS

| | | | |
|---|---|---|---|
| 605,268 | 6/1898 | Burfoot | 248/501 |
| 887,663 | 5/1908 | Lee | 248/188.9 |
| 3,838,883 | 10/1974 | Machen | 248/188.9 X |
| 4,046,814 | 12/1977 | Pokorny et al. | 248/188.8 X |
| 4,135,690 | 1/1979 | Clarke et al. | 248/188.8 X |
| 4,564,237 | 1/1986 | Steifensand | 248/188.8 X |
| 4,807,720 | 2/1989 | Kim | 248/188.8 X |

*Primary Examiner*—Ramon O. Ramirez

*Attorney, Agent, or Firm*—Milton S. Gerstein

[57] ABSTRACT

A stabilizer for a lawn chair, sand chair, chaise lounge, as well as other similar chairs, which, in a first embodiment, has an adapter that readily fits over the front and/or rear lower horizontal tubing of the chair-frame, which adapter is provided with right-angled end-corners directly and laterally adjacent the rounded, curved ends of the respective lower horizontal tubing, where such lower horizontal tubing curve upwardly in transition to join with an upwardly, angularly-extending upright tubing of the chair-frame, whereby such curved ends, about which lateral tipping over typically occurs, are negated. In a second embodiment, the stabilizer of the invention snap-fits onto a lower horizontal tubing of the chair-frame, with such stabilizer also having a length greater than the length of the lower horizontal tubing, the ends of which stabilizer are provided with generally triangular-shaped, flat projections. The stabilizer is readily rotatable about the lower horizontal tubing to which is attached, so that the end-projections may be oriented at any desired angle. Thus, the flat end-projections may be oriented so that they lie flat against the ground when the chair is used on firm ground or cement, or may be oriented 90 degrees therefrom so that the pointed apices or corners of each flat end-projection faces toward the ground, which is especially useful when using a chair on soft sand.

15 Claims, 2 Drawing Sheets

LAWN CHAIR STABILIZER

BACKGROUND OF THE INVENTION

The present invention is directed to a device for stabilizing a lawn chair, sand chair, and the like, to prevent the tipping over thereof when a person is seated therein. Lawn chairs, sand chairs, and the like, are typically collapsible or foldable and are made of light, metal tubing allowing for such folding when the chair is not in use. Such chairs are very unstable and are easily laterally tipped over when a person seated thereon is not careful and leans to far over to one side or rocks the chair, which may cause injury.

SUMMARY OF THE INVENTION

It is, therefore, the primary objective of the present invention to provide a stabilizer for a lawn chair that will make the chair more stable and less prone to lateral tipping over.

It is another objective of the present invention to provide such a lawn chair stabilizer that will be readily retrofitted to all existing and types of lawn chairs, sand chairs, chaise lounges, and the like.

Toward these and other ends, the stabilizer for a lawn chair, sand chair, chaise lounge, as well as other similar chairs, is, in a first embodiment thereof, an adapter that readily fits over the front and/or rear lower horizontal tubing of the chair-frame, which adapter is provided with right-angled end-corners directly and laterally adjacent the rounded, curved ends of the respective lower horizontal tubing, where such lower horizontal tubing curve upwardly in transition to join with an upwardly, angularly-extending upright tubing of the chair-frame, whereby such curved ends, about which lateral tipping over typically occurs, are negated.

In a second embodiment, also useful for lawn chairs, but ideally suited for sand chairs, the stabilizer of the invention snap-fits onto a lower horizontal tubing of the chair-frame, with such stabilizer also having a length greater than the length of the lower horizontal tubing, the ends of which stabilizer are provided with generally triangular-shaped, flat projections. The stabilizer is readily rotatable about the lower horizontal tubing to which is attached, so that the end-projections may be oriented at any desired angle. Thus, the flat end-projections may be oriented so that they lie flat against the ground when the the chair is used on firm ground or cement, or may be oriented 90 degrees therefrom so that the pointed apices or corners of each flat end-projection faces toward the ground, which is especially useful when using a chair on soft sand, where the pointed corners or apices will dig into the sand to increase stability to prevent tipping over.

BRIEF DESCRIPTION OF THE DRAWINGS

The invention will be more readily understood with reference to the accompanying drawing, wherein.

DETAILED DESCRIPTION OF THE INVENTION

Figure 2:
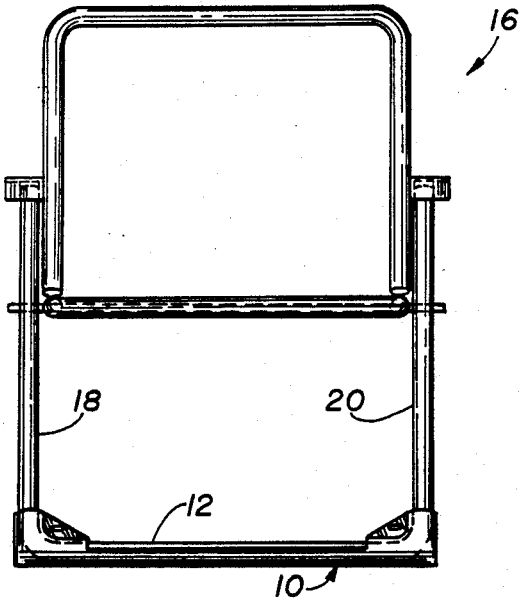
FIG. 2 is a front view thereof.
Figure 3:
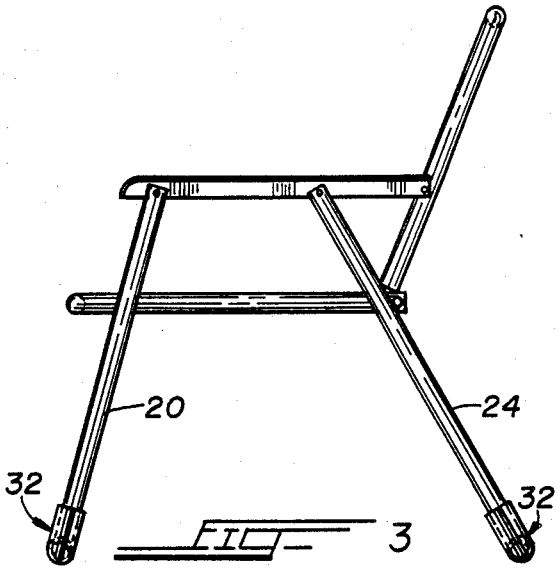
FIG. 3 is a side elevational view thereof.
Figure 4:
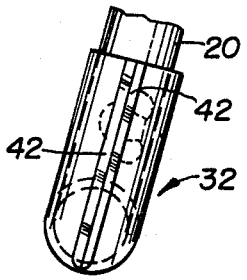
FIG. 4 is an enlarged detail view, in side elevation, showing the lawn chair stabilizer of the invention in its closed, attached state to the bottom tubing of a lawn chair.
Figure 5:
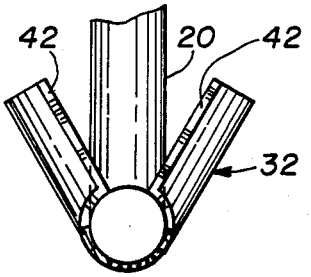
FIG. 5 is a view similar to FIG. 4 but showing the lawn chair stabilizer of the invention in its open, unattached state.
Figure 6:
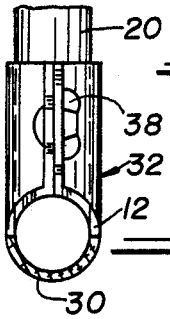
FIG. 6 is a cross-sectional view of the stabilizer of the invention taken along line 6—6 of FIG. 8 showing the means by which it is clamped to a lower horizontal tubing of a lawn chair-frame.
Figure 1:
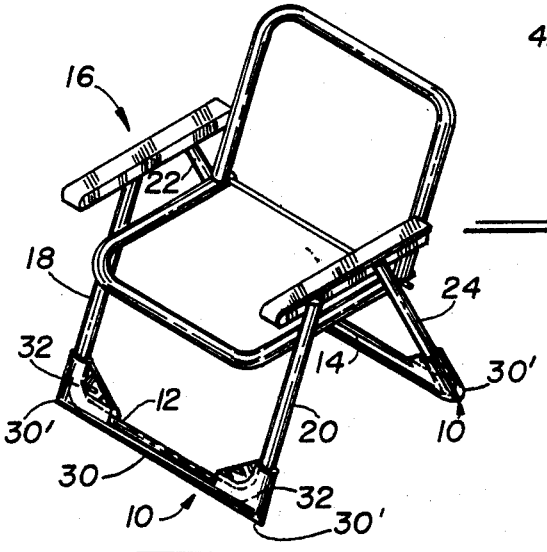
FIG. 1 is an isometric view showing the first embodiment of the lawn chair stabilizer of the invention shown attached to the front and rear lower frame-tubings of a lawn chair.
Figure 7:
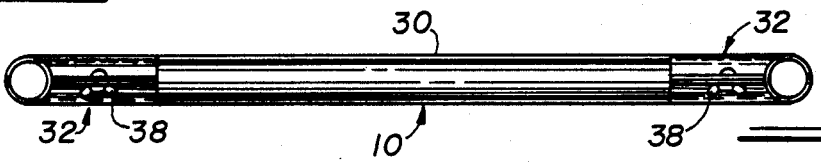
FIG. 7 is a top view of the lawn chair stabilizer isolated, in its closed, clamping state.
Figure 8:
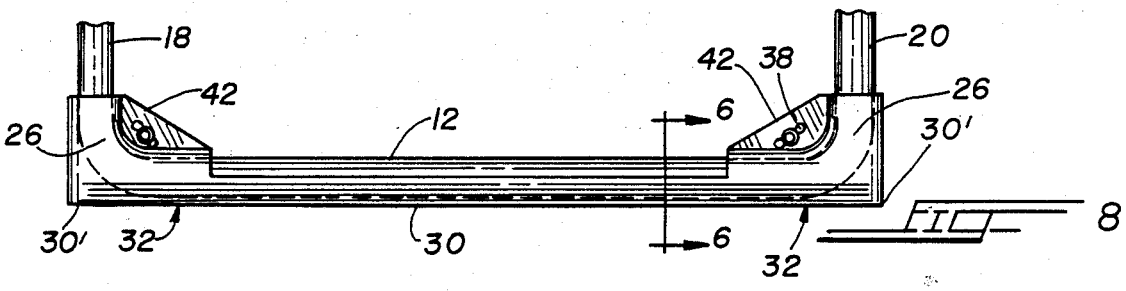
FIG. 8 is an enlarged partial front view showing the lawn chair stabilizer clamped to a lower horizontal tubing of a chair-frame.
Figure 10:
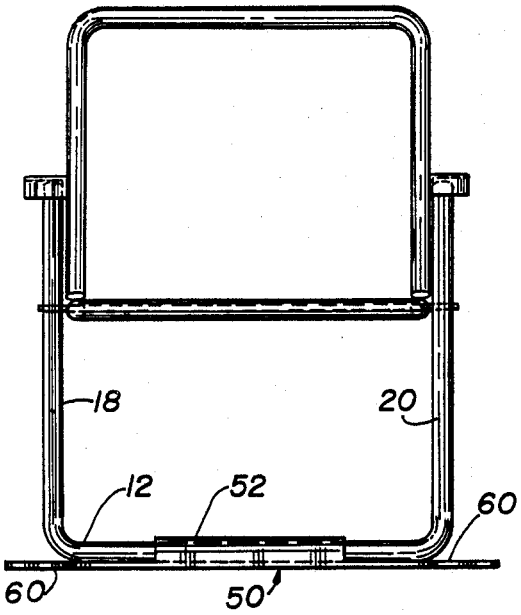
FIG. 10 is a front view thereof.
Figure 11:
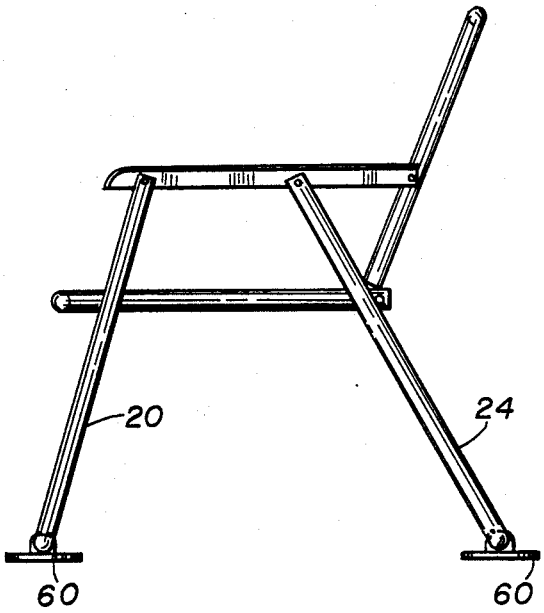
FIG. 11 is a side elevational view thereof.

Referring now to the drawings in greater detail, and for now to FIGS. 1–8, the first embodiment of the stabilizer for lawn chairs, sand chairs, chaise lounges, and the like, is indicated generally by reference numeral 10. In the drawings, there are shown two such stabilizers mounted to the front and rear lower horizontal tubings 12, 14 of a lawn chair or sand chair 16. While two such stabilizers 10 are shown, of course only one may be used, either attached to the front or rear horizontal tubing of the chair-frame. The chair-frame is comprised of a plurality of usually hollow aluminum tubings, including the lower horizontal tubings 12, 14, and also upwardly, angularly-extending forward upright tubings 18, 20, and upwardly, angularly-extending rear upright tubings 22, 24, such a chair-frame being conventional. These chair-frames are unstable, and prone to tipping over laterally, since the transition regions 28, where the lower horizontal tubings join with the upright tubings, are curved, such offering a perfect fulcrum about which the chair-frame may be rotated and tipped over for only a slight lateral moment created by a person sitting in the chair, such as when he or she leans over one of the sides of the chair. The stabilizer 10 effectively eliminates such curved transition regions 26 and, in a retrofit-type manner, replaces it with right-angled, or square, connections, to thus accommodate greater lateral moments created by a person leaning over, to thereby prevent the tipping over of the chair. Each stabilizer 10 includes a generally central, elongated semi-cylindrical portion 30 into which is nestled the generally straight main portion of a lower horizontal tubing 12 or 14. The portion 30 may also be rectilinear shaped, such as a square, and defining such a semi-cylindrical portion at its top for receiving the main straight portion of a respective tubing. Such a rectilinear shape would also provide additional stability in the forward and rear directions as desired. Projecting from either end of the central portion 30 is a right-angle, clamshell-like, clamp-adapters 32 for mounting to the chair-frame at the transition regions 26. These adapters 30 define a lower right-angle 30' which converts the curved transition regions into a right-angle transition for added stability, as described above. The stabilizer 10 is preferably made of the same material as the chair-frame, aluminum, although other material may be used as well. Each adapter 32 is flexible so that it tends to its opened, unclamped state, as shown in FIG. 5. The stabilizer 10 is made of one integral piece of extruded aluminum. Each adapter 32 has associated with it a screw having an integrally-connected wing-nut head 38, which screw is threaded through a pair of mutually-aligned threaded holes formed in each half-shell of the adapter 32, by which it the two half-shells are drawn together and closed and clamped about a respective curved transition region 26, as shown in FIGS. 4 and 6. The wing-nut head allows for easy gripping by a hand and easy rotation of the screw for facile attachment and detachment of the stabilizer to a lawn chair. The wing-nut headed screw and the associated holes are preferably located inwardly of the transition regions 28, as clearly seen in FIG. 8, so that both the adapters 32 and the central portion 30 are simultaneously clamped about the respective, juxtapositioned tubings thereat, to ensure greater clamping attachment of the stabilizer to the frame tubing. Thus, each adapter 32 is provided with an interior shell-extension 42 made up of two half-shells where the threaded holes for the wing-nut screw are provided, as clearly shown in FIGS. 7 and 8.

Figure 9:
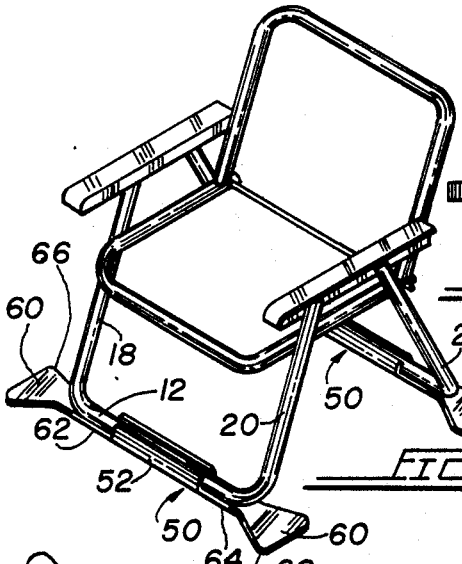
FIG. 9 is an isometric view showing the second embodiment of the lawn chair stabilizer of the invention shown attached to the front and rear lower frame-tubings of a sand or lawn chair.
Figure 12:
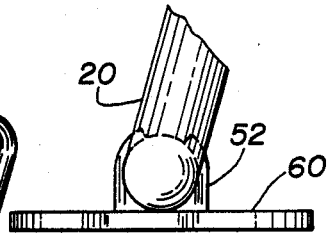
FIG. 12 is an enlarged detail view, in side elevation, showing the lawn chair stabilizer of the invention in its closed, attached state to the forward bottom tubing of a lawn chair.
Figure 13:
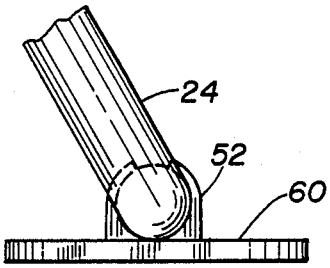
FIG. 13 is an enlarged detail view, in side elevation, showing the lawn chair stabilizer of the invention in its closed, attached state to the rear bottom tubing of a lawn chair.
Figure 14:
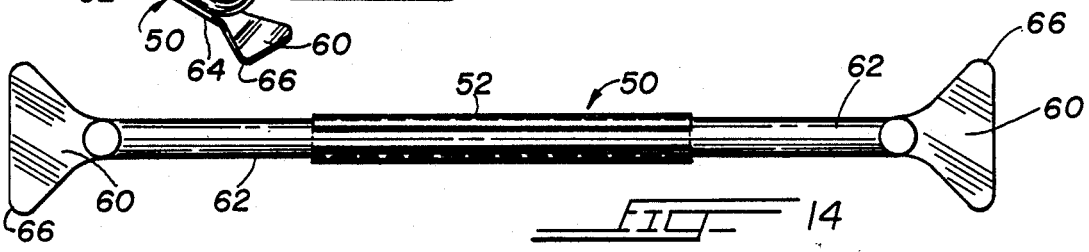
FIG. 14 is a top view of the lawn chair stabilizer proper.
Figure 15:
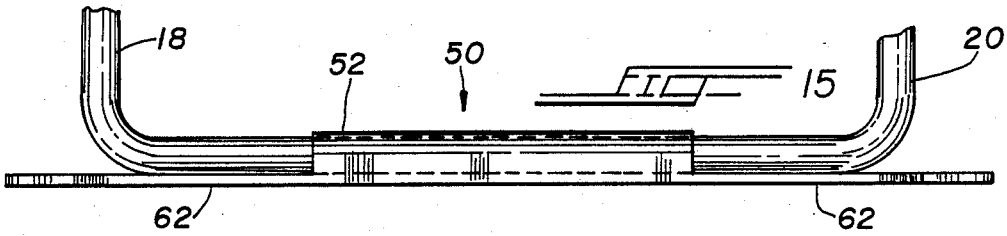
FIG. 15 is an enlarged partial front view showing the lawn chair stabilizer clamped to a lower horizontal tubing of a chair-frame.

A second embodiment of the invention is shown in FIGS. 9–15, which may be used with a lawn chair, chaise lounge, and the like, but has especial use for sand chairs. The stabilizer 50 of this embodiment is preferably made of hard but flexible plastic, has a length greater than the length of a respective tubing 12, 14, and has a central straight section 52 in the shape of an axially-slotted or gapped cylinder which snap-fits over the central portion of a lower horizontal tubing 12, 14. The slot or gap 52' is of sufficient width to allow for passage past the tubing while being secured thereto, such securement procedure simply causing the flexible cylinder to flex outwardly during attachment, causing the gap to widen even more until of sufficient width to envelope the outer diametric extent of the tubing 12, 14 until the cylinder 52 is forced upwardly and entrained around the respective tubing 12, 14. The diameter of the cylinder 52, in its unflexed state, is preferably such so as to keep the stabilizer securely attached to the tubing 12, 14 so that the stabilizer will be substantially firmly attached. However, the stabilizer 50 about the tubing 12, 14 may be oriented in a desired position, for suiting the terrain upon which the chair is supported, as set forth below. Projecting from each lower end of the cylinder 52 is a triangular-shaped or trapezoidal-shaped flat stabilizing element 60 integrally connected to a lower end surface of the cylinder 52 via a flat: connector 62, 64. As shown in FIG. 9, the stabilizing elements may be oriented so as to be flat and flush against the ground for preventing lateral overturning of the chair. However, the stabilizer 50 may be attached to the tubing 12, 14 in such a manner that it is 90 degrees offset from that shown in FIG. 9, so that the corners or apices 66 face downwardly, with the stabilizing elements 60 lying in substantially vertical planes, whereby the thus-provided lower corners 88 may be dug into the ground, such as sand, for increasing the stability of the chair. Conversion from one orientation to another for the stabilizer 50 may be easilY accomplished by simply rotating the cylinder 52 about the tubing 12, 14 to overcome the frictional retaining resistance therebetween, or the stabilizer 50 may be initially oriented in the desired orientation when the cylinder is being snap-fitted to a tubing 12, 14 at the outset.

While specific embodiments of the invention has been shown and described, it is to be understood that numerous changes and modifications may be made therein without departing from the scope, spirit and intent of the invention as set forth in the appended claims.

What I claim is:

1. In a chair comprising a main frame having a front lower frame member, and a rear lower frame member, a pair of front upright members connected to the ends of said front lower frame member, and a pair of rear upright members connected to the ends of said rear lower frame member, each of said upright members being connected to a respective end of a respective said lower frame member by a curved transition portion, the improvement comprising:

at least one stabilizing adapter secured to at least one of said front and rear lower frame members for stabilizing said main frame in the lateral directions for helping to prevent the toppling of said main frame by a person seated thereon;

said stabilizing adapter comprising a first right-angle member coupled to one said curved transition region of said at least one lower frame member, and a second right-angle member coupled to another said curved transition region of said at least one lower frame member, said one and said another transition regions being connected to the same one of said front and rear lower frame members.

2. The improvement according to claim 1, wherein each of said first and second right-angle members comprises a clamshell-type clamping element comprising a first shell-half and a second shell-half, a respective said one of said one and said another transition regions being sandwiched therebetween, and means for retaining said shell-halves in a closed, clamping state with a transition region therebetween.

3. The improvement according to claim 2, wherein each said right-angle member defines an exterior right-angle surface positioned exteriorly and laterally outwardly of a respective said transition region, whereby the chair frame is supported thereby.

4. The improvement according to claim 1, wherein said at least one stabilizer adapter comprises an intermediate connector portion connecting said first and second right-angle members together.

5. The improvement according to claim 4, wherein said intermediate connector portion comprises a semi-cylindrical element in which is nestles a respective one of said front and rear lower frame member.

6. The improvement according to claim 2, wherein said means for retaining comprises a screw having a wing-nut head, each said half-shell having a hole for reception therein of a portion of said screw, whereby said screw upon rotation in one direction, forces said half-shells toward each other.

7. The improvement according to claim 4, wherein each said right-angle member's half-shell further comprises an interior shell-extension extending inwardly away from the respective said right-angle surface, said stabilizer adapter further comprising means for retaining said right-angle surface to a respective said transition surface, said means for retaining being operatively associated with said interior shell-extensions of said half-shells.

8. The improvement according to claim 7, wherein said means for retaining comprises a screw having a wing-nut head, each said half-shell extension having a hole for reception therein of a portion of said screw, whereby said screw upon rotation in one direction, forces said half-shells toward each other.

9. In a chair comprising a main frame having a front lower frame member, and a rear lower frame member, a pair of front upright members connected to the ends of said front lower frame member, and a pair of rear upright members connected to the ends of said rear lower frame member, each of said upright members being connected to a respective end of a respective said lower frame member by a curved transition portion, the improvement comprising:

at least one stabilizing adapter secured to at least one of said front and rear lower frame members for stabilizing said main frame in the lateral directions for helping to prevent the toppling of said main frame by a person seated thereon; said at least one stabilizing adapter comprising a pair of end-projecting flat surfaces each defining at least one corner, said flat surfaces being operatively connected to one said lower frame member.

10. The improvement according to claim 9, wherein said stabilizing element comprises a means for attaching said flat surfaces to said one lower frame member; said means for attaching comprising a central member integrally connected to both said flat surfaces, said central member being adjustably connected to said one lower frame member.

11. The improvement according to claim 10, wherein said central member comprises an axially-slotted cylindrical tube for encircling a portion of said one lower frame member; the length of said stabilizing adapter as taken between said at least one corners of said flat surfaces being greater than the length of said one lower frame member and two associated said transition portions combined.

12. The improvement according to claim 11, wherein said central member is adjustably positionable about said one lower frame member in order to orient said flat surfaces in a desired orientation.

13. The improvement according to claim 12, wherein each said flat surface comprises two said corners where each said corner may be inserted into sand or soft ground for stabilizing said frame.

14. A method of using a chair having a stabilizing adapter, said chair comprising a main frame having a front lower frame member, and a rear lower frame member, a pair of front upright members connected to the ends of said front lower frame member, and a pair of rear upright members connected to the ends of said rear lower frame member, each of said upright members being connected to a respective end of a respective said lower frame member by a curved transition portion, said stabilizer adapter being secured to one of said front and rear lower frame members for stabilizing said main frame in the lateral directions for helping to prevent the toppling of said main frame by a person seated thereon, said stabilizer comprising a pair of end-projecting flat surfaces each defining at least one corner, said flat surfaces being operatively connected to one said lower frame member, and a means for mounting said flat surfaces to said one lower frame member, said method comprising:

(a) orienting said means for mounting so that said flat surfaces lie parallel to and supported on the support surface therebelow;

(b) rotating said means for mounting relative to said one lower frame member so that said flat surfaces extend at one of an acute angle and at right angle to the support surface therebelow; and (c) inserting said corners of said flat surfaces into the support surface therebelow for enhancing the stability of the chair.

15. In a chair comprising a main frame having a front lower frame member, and a rear lower frame member, a pair of front upright members connected to the ends of said front lower frame member, and a pair of rear upright members connected to the ends of said rear lower frame member, each of said upright members being connected to a respective end of a respective said lower frame member by a curved transition portion, the improvement comprising:

two stabilizing adapters, one mounted to said front lower frame member, and one mounted to said rear lower frame member.

* * * * *